US005172883A

United States Patent [19]

Amirian

[11] Patent Number: 5,172,883

[45] Date of Patent: Dec. 22, 1992

[54] ARTIST'S TOOL

[76] Inventor: Acop J. Amirian, 132 E. Walnut St., Goldsboro, N.C. 27530

[21] Appl. No.: 807,112

[22] Filed: Dec. 13, 1991

[51] Int. Cl.[5] ..... A47G 1/24

[52] U.S. Cl. ..... 248/441.1; 248/118; 248/285; 248/287; 248/279

[58] Field of Search ..... 248/118, 118.1, 118.3, 248/118.5, 441.1, 448, 460, 287, 298, 274, 279, 286, 285, 295.1; 403/4, 388, 400; 33/470, 473, 468

[56] References Cited

U.S. PATENT DOCUMENTS

| | | | |
|---|---|---|---|
| 289,700 | 12/1883 | Parker . | |
| 375,049 | 12/1887 | Coughlin | 33/473 |
| 453,385 | 6/1891 | Parkinson | 33/473 |
| 462,265 | 11/1891 | Mason | 248/274 X |
| 964,785 | 7/1910 | Johnson | 33/468 X |
| 1,636,637 | 7/1927 | Hutchison | 33/473 X |
| 1,655,638 | 1/1928 | West | 33/468 |
| 1,691,118 | 11/1928 | Lissy | 33/473 |
| 2,496,276 | 2/1950 | Dolas . | |
| 2,799,464 | 7/1957 | D'Azzo | 248/298 X |
| 2,947,306 | 8/1960 | Culkin | 248/287 X |
| 2,979,303 | 4/1961 | Freeman | 248/287 |
| 3,101,568 | 8/1963 | Tratt . | |
| 3,715,097 | 2/1973 | Kalajian | 248/460 X |
| 3,815,856 | 6/1974 | Cortimilia . | |
| 4,088,290 | 5/1978 | Dovello . | |
| 4,685,644 | 8/1987 | Yates . | |
| 5,069,411 | 12/1991 | Murphy | 248/287 X |

*Primary Examiner*—Alvin C. Chin-Shue
*Attorney, Agent, or Firm*—Rhodes, Coats & Bennett

[57] ABSTRACT

An apparatus to assist a painter in painting a canvas resting on an easel having a ledge includes a first and second rails joined together by a pivotal connection. The pivotal connection is adjustably located along the length of the first and second rails tightenable to secure the rails in a set pivotal configuration along the adjustable lengths. The first rail includes a backing plate and a slotted forward plate bound to the backing plate and having a widened slot portion where the forward plate is bound to the backing plate. The second rail has a slot, and the connection is a nut and a bolt, with the bolt head located in the widened slot portion. The stem extends out through the slotted forward plate and through the slot in the second rail and has the nut secured thereto. The second rail is of adjustable length and has a lower end with a V- shaped notch defining two spaced apart ears and two sets of holes in the ears, so that each ear has two holes aligned with similar holes in the other ear. An additional segment extension for the second rail has a V-shaped protrusion with holes in the protrusion so that the second rail may be lengthened by positioning the additional segment at the lower end of the second rail and securing the segment to the lower end of the second rail by fasteners extending through the aligned holes in the ears and the protrusion. The first rail can rest securely on top of the canvas as it rests on the ledge of the easel. The second rail can be supported by being bound to the first rail by the connection and by contacting the ledge without touching the canvas, thereby permitting an artist to rest his or her painting hand on the second rail while painting.

20 Claims, 2 Drawing Sheets

ARTIST'S TOOL

BACKGROUND OF THE INVENTION

The present invention relates to a new tool for use by artists, particularly those who paint on canvases stretched on stretcher bars.

The historic and time-honored way to steady a painter's hand for detail work is to use a mahl-stick. Mahl-sticks are 2' long sticks with a ball mounted atone end. The ball is pressed against a dry portion of the canvas and held in place with one hand, so that the painter's painting hand can rest on the stick and be steadied by the stick as detail work is done. Numerous problems accompany the use of mahl-sticks. They press dents into the canvas, and they require a dry spot or unpainted area to rest the ball of the mahl-stick. Moreover, both hands are required to paint, so that there is not a hand free to hold a pallet or other tools. Finally, since the mahl-stick is held by hand, it is still not prefectly steady.

Various efforts have been made over the years to replace mahl-sticks or provide other devices for artists to support their hands when doing close work, as exemplified by the following patents:

U.S. Pat. No. 289,700 to Parker discloses a mahl-stick having a roller mounted at one end to allow it to travel laterally on a track affixed to the top of the easel so that the position of the mahl-stick can be modified left to right.

U.S. Pat. No. 2,496,276 to Dolas discloses a mahl-stick having two ends which are urged together by an internal spring. Thus, the mahl-stick pinches the edges of the work surface, such as a drawing board, to hold it in place.

U.S. Pat. No. 3,101,568 to Tratt discloses a drafting device including abridging arm which mounts in grooves over a board and has a movable support for the artist's hand.

U.S. Pat. No. 3,815,856 to Cortimilia discloses a fairly elaborate device to be added to an easel so that a traditional mahl-stick can be pivotally mounted to one side and supported in a notch on the other side of the easel.

U.S. Pat. No. 4,088,290 to Novello discloses a mahl-stick that can be extended or retracted and clamped to the sides of a canvas.

U.S. Pat. No. 4,685,644 to Yates discloses a mahl-stick provided with a clamp to clamp one end of the stick to the side of the canvas, but the other end is still supported by the artist's hand.

None of the apparatuses described in the foregoing patents appears to be used in practice for one reason or another, perhaps because they are too expensive to manufacture, or they simply do not provide sufficient advantages over the traditional mahl-stick described above.

Also, artists often work with different size canvases over a period of time and the devices shown in the prior patents perhaps do not provide the versatility that artists would find desirable to permit them to use the product on a wide range of canvases. Moreover, for large canvases, it is desired that a hand-steadying device be capable of being used over the entire canvas, without undue effort being needed to re-position the supporting device with respect to the canvas.

Accordingly, there is a need in the art for a versatile tool to steady an artist's hand usable over a wide range of canvas sizes as well as to permit the painter to have support over practically the entire surface of each and every canvas to be worked on.

SUMMARY OF THE INVENTION

The present invention fulfills this need in the art by providing an apparatus to assist a painter in painting a canvas resting on an easel having a ledge. First and second rails are joined together by a pivotal connection, the pivotal connection being adjustably located along the length of one of the first and second rails and being tightenable to secure the rails in a set pivotal configuration along the adjustable length. Thus, the first rail can rest securely on top of the canvas as it rests on the ledge of the easel, and the second rail can be supported by being bound to the first rail by the connection and by contacting the ledge, without touching the canvas. This permits an artist to rest his or her painting hand on the second rail while painting. Preferably, the location of the pivotal connection is adjustable along both of the first and second rails. In a preferred embodiment the location of the pivotal connection is adjustable by being slidable in a slot in one of the rails.

Preferably, the second rail is of adjustable length. This can be accomplished if the second rail has a lower end with a V-shaped notch defining two spaced apart ears and two sets of holes in the ears, so that each ear has two holes aligned with similar holes in the other ear. An additional segment is also provided having a V-shaped protrusion with holes in the protrusion. The second rail may be lengthened by positioning the additional segment at the lower end of the second rail and securing the segment to the lower end of the second rail by fasteners extending through the aligned holes in the ears and the protrusion. If desired, a plurality of additional segments of this type can be provided to make the second rail longer yet.

In a preferred embodiment the first rail includes a backing plate and a slotted forward plate bound to the backing plate and having a widened slot portion where the forward plate is bound to the backing plate. The connection of the first and second rails can take the form of a nut and a bolt, the bolt having a head and a stem. The head of the bolt is located in the widened slot portion with the stem extending out through the slotted forward plate to engage the second rail and be secured thereto by the nut. This is particularly advantageous if the second rail has a slot and the stem extends through the slot.

The invention also provides a method of painting a picture on a canvas comprising several steps: placing the canvas on the ledge of an easel, positioning a first rail on the top of the canvas as the canvas rests on the easel, locating a second rail supported by a pivotal connection to the first rail so that it contacts the ledge and extends over a region of the canvas adjacent a portion of the canvas to be painted, resting a hand holding a paintbrush on the second rail to steady the hand, and painting with the steadied hand.

The positioning step may include adjusting the position of the first rail so that its pivotal connection is over the region of the canvas to be painted. The positioning step may include adjusting the position of the pivotal connection on the first rail so that pivotal connection is over the region of the canvas and a majority of the length of the first rail contacts the top of the canvas.

If a longer canvas is to be painted, the method may include adjusting the length of the second rail by adding segments to it.

The locating step may include pivoting the connection with the first rail to an angle other than 90° and securing the second rail to the first rail after pivoting. The locating step may also or alternatively include moving the second rail vertically with respect to the first rail and securing the second rail to the first rail after the move. Preferably, the locating step includes adjusting the location of the pivoting connection with the first rail so that the second rail extends below the ledge about two inches and securing the second rail to the first rail.

The various positioning and locating steps need not take place in the order set forth.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 2:
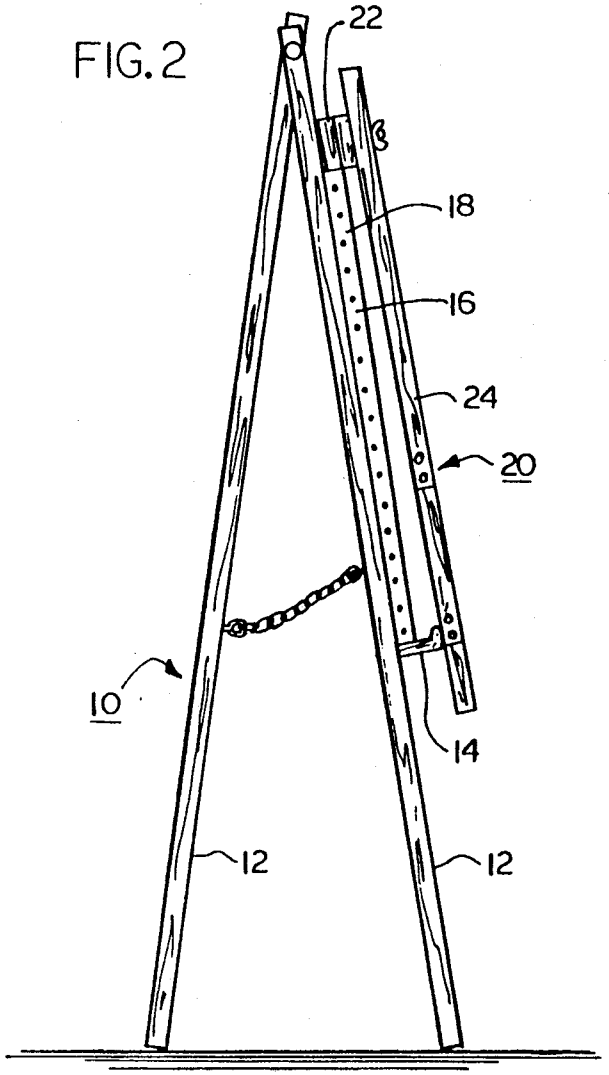
FIG. 2 is a side perspective view of an easel and canvas equipped with an embodiment of the apparatus according to the invention.

Typically, an artist paints a painting on a canvas with the canvas typically being stretched over a rectangular frame of bars called stretcher bars. The canvas is then stapled or tacked to the stretcher bars to hold in its taut condition over the stretcher bars. It is conventional for these assemblies, conventionally called "canvases", to be supported on an easel on a convenient working level for the artist. A typical arrangement can be seen in FIG. 1. An easel 10 having typically three legs 12 connected in a tripod-type configuration has two of the legs spanned by a ledge or shelf 14. The canvas 16 then rests on the shelf, leaning back on two of the legs 12, as better seen in the side view shown in FIG. 2. Also, as can be seen in FIG. 2, the stretcher bars 18 provide some rigidity and compressive strength to the canvas. Other surfaces to be painted which have such compressive strength and are suitable for mounting on an easel are contemplated in this application as being within the scope of the term "canvas".

The tool 20 of the present invention includes two primary elements, a horizontal rail 22 and a vertical rail 24. The horizontal rail 22 is made up of a solid backing plate 26 and a slotted front plate 28, joined together by nails 29 (see FIG. 4). The slot 30 in the horizontal rail 22 extends most of the length of the rail 22, terminating short of both ends, however.

Figure 3:
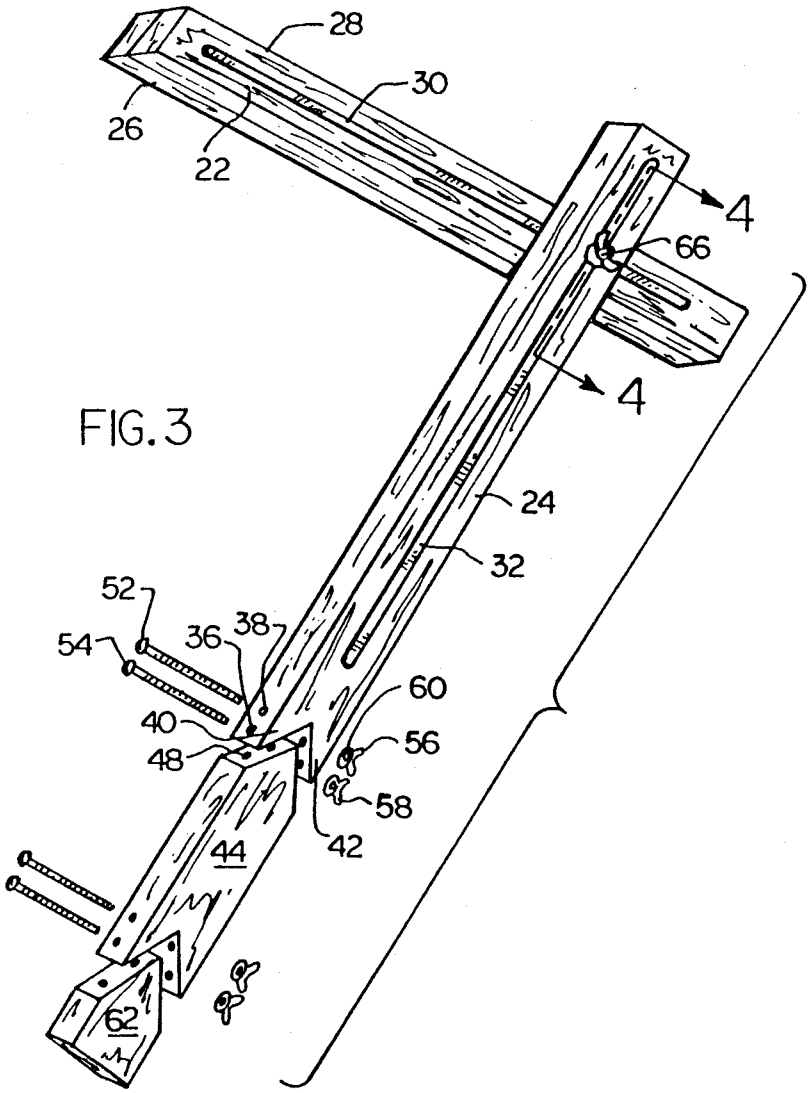
FIG. 3 is an enlarged perspective view of an embodiment of the apparatus according to the invention.

The vertical rail 24 also is provided with a slot 32 which extends entirely through the vertical rail 24 and, as with the slot in horizontal rail 22, extends along a substantial proportion of the length of the vertical rail 24, but terminates short of the two ends. The lower end of the vertical rail 24 has a V-shaped notch 34, best seen in FIG. 3. The notch forms ears 40,42 having aligned holes 36,38. That is, the hole 36 in ear 40 is generally co-linear with the hole 36 in ear 42, and the same is true for the holes 38.

An extension segment 44 is desirably provided for rail 24 including a pointed end 46 having holes 48,50 formed therein to align with the holes 36,38 of the lower end of the rail 24. Thus, when the pointed end 46 is inserted into the notch 34, the respective holes are aligned, and bolts can be passed through them and secured into place by washers and wingnuts. The bolts, washers and wingnuts are not shown, but they are substantially identical to the bolts 52,54 and wingnuts 56,58 and washers 60 shown at a similarly notched end of the extension segment 44. An end cap 62 having a pointed end like the pointed end of the extension segment is also provided with holes. End cap 62 provides a squared off bottom for the assembled vertical rail component and attaches to the notched end of either the vertical rail 24 or the extension segment 44, depending upon the vertical length needed.

Figure 4:
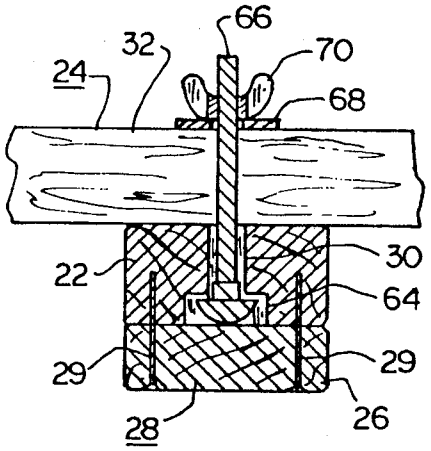
FIG. 4 is a sectional view of the embodiment of FIG. 3 taken along lines 4—4 looking in the direction of the arrows.

As can be seen in FIG. 4, the vertical and horizontal rails are joined by a bolt 66 having a head lodged in a widened portion 64 of the slot 30 of rail 22. The bolt also passes through the slot 32 in the rail 24 and has a washer 68 and wingnut 70 mounted thereon so that the rails 22,24 can be clamped together in a fixed configuration. When they are not clamped, the bolt 66 is free to be moved along their lengths, and the rails are free to pivot with respect to one another about the bolt 66. Thus, a desired configuration including horizontal and vertical placement and angular relation between the rails can be selected by loosening the nut 70 and moving the rails as desired, and can be retained by tightening the nut 70 to clamp the rails together in the selected configuration.

A preferred material for the bars is wood, but other materials can be substituted and other configurations beyond those specifically described herein can be implemented. In a preferred embodiment, the horizontal rail 22 is $1\frac{1}{2}$ inches wide and $1\frac{1}{4}$ inches deep, being made up of a $\frac{1}{2}$ inches thick backing plate 26 and a $\frac{3}{4}$ inch front plate 28. A plurality of nails 29 are provided binding the two plates together, along with, preferably, a supply of wood glue between the joined parts. In one embodiment, the horizontal rail has an overall length of $14\frac{1}{4}$ inches.

Similarly, the vertical rail 24 preferably has a thickness of about $\frac{3}{4}$ of an inch and an overall width of about 2 inches. A preferred embodiment is $22\frac{1}{2}$ inches long. The end cap 62 is preferably about 4 inches long while the extension segments 44 have an overall length of about 12 inches. The slots 30,32 are typically about $\frac{1}{4}$ inch wide.

As will be apparent, other dimensions can be used, if desired.

The method of use of the apparatus will be described again with reference to FIGS. 1 and 2. After the artist has placed his or her canvas 16 on the ledge 14 of the easel as is conventional, he or she can position the tool 20 by placing the rail 22 on top of the canvas, with a lower end of the vertical rail resting against the ledge 14. The effective length of the rail 24 can be adjusted by adding or removing segments 44, as desired. It is convenient for the artist to have the lower end of the rail extend below the shelf 14 by about 2 inches to assure that it does not slip off onto the canvas, even under considerable pivoting. The vertical location of the rail 24 with respect to the rail 22 can be adjusted to achieve this result, in addition to adjusting the overall length of the rail 24.

Figure 1:
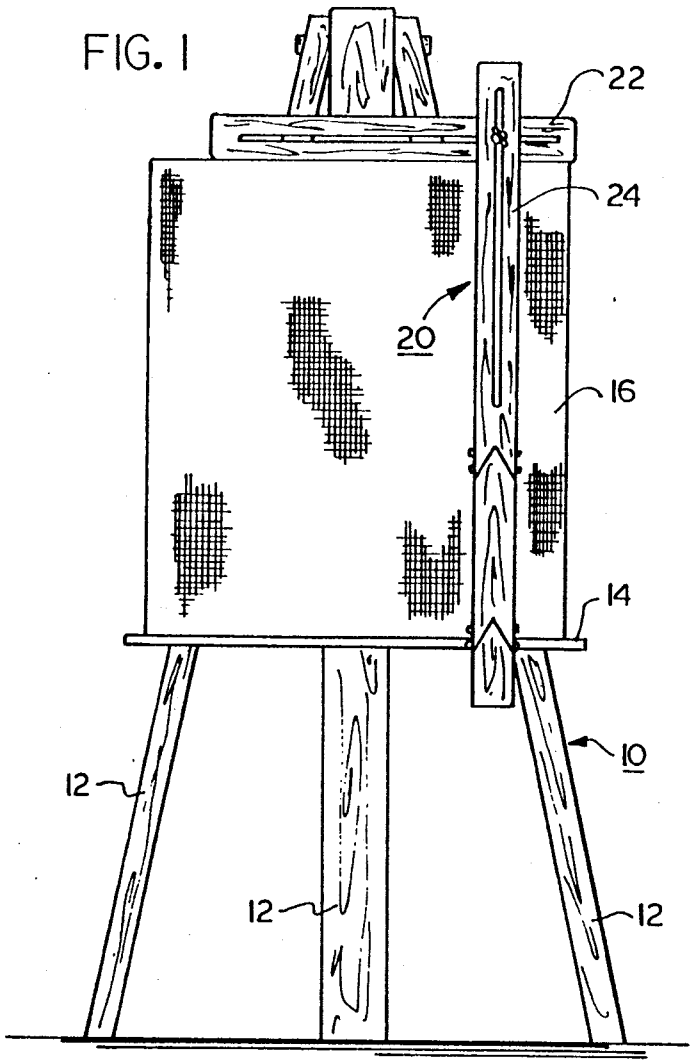
FIG. 1 is a front perspective view of an easel and canvas equipped with an embodiment of the apparatus according to the invention.

As can be seen from FIGS. 1 and 2, the vertical rail 24 passes close by, but does not touch the canvas 16, so that the artist can rest his or her hand on the rail 24 to steady the hand for careful painting of the canvas 16. The artist can move his or her hand up and down the rail 24 as desired.

When it is desired to work to the side of the location made available by a particular placement of the rail, the rail 24 can be moved in a number of ways. First, the wingnut 70 can be loosened to allow the rail 24 to be pivoted with respect to the rail 22 to bring a working area of the rail 24 to the point to be worked on. Retightening of the nut at that point will maintain the rail 24 in the desired orientation. Alternatively, the nut 70 can be loosened so that the vertical rail 24 and the bolt 66 move laterally in the slot 30 to locate the rail 24 at a different region of the canvas 16. Finally, the entire assembly of the rail 22,24 can be moved with respect to the canvas 16 to relocate a working area made available adjacent the vertical rail 24.

Since the apparatus sits along the top edge of the canvas and the canvas is at a slightly backward tilt, the entire assembly is stable.

Those of ordinary skill in the art will appreciate that various modifications to the invention as described herein will be possible without falling outside the scope of the invention.

What is claimed is:

1. A painting arrangement for a painter comprising a canvas resting on an easel having a ledge and a tool having first and second rails joined together by a pivotal connection, said pivotal connection being adjustably located along the length of one of said first and second rails and being tightenable to secure said rails in a set pivotal configuration along said adjustable length, said first rail resting securely on top of the canvas as it rests on the ledge of the easel and said second rail being supported by being bound to said first rail by said connection and and by contacting the ledge without touching the canvas, thereby permitting an artist to rest his or her painting on the second rail while painting.

2. An apparatus as claimed in claim 1 wherein the location of said pivotal connection is adjustable along both of said first and second rails.

3. An apparatus as claimed in claim 1 wherein the location of said pivotal connection is adjustable by being slidable in a slot in one of the rails.

4. An apparatus as claimed in claim 1 wherein said second rail is of adjustable length.

5. An apparatus as claimed in claim 1 wherein said first rail includes a backing plate and a slotted forward plate bound to said backing plate and having a widened slot portion where the forward plate is bound to said backing plate.

6. An apparatus as claimed in claim 5 wherein said connection comprises a nut and a bolt, said bolt having a head and a stem, said head being located in said widened slot portion with the stem extending out through the slotted forward plate to engage said second rail and be secured thereto by said nut.

7. An apparatus as claimed in claim 6 wherein said second rail has a slot and said stem extends through said slot.

8. An apparatus to assist a painter in painting a canvas resting on an easel having a ledge comprising first and second rails joined together by a pivotal connection, said pivotal connection being adjustably located along the length of said first and second rails and being tightenable to secure said rails in a set pivotal configuration along said adjustable length, said first rail including a backing plate and a slotted forward plate bound to said backing plate and having a widened slot portion where the forward plate is bound to said backing plate, said second rail having a slot, said connection comprising a nut and a bolt, said bolt having a head and a stem, said head being located in said widened slot portion with the stem extending out through the slotted forward plate and through said slot in said second rail and having said nut secured thereto, said second rail being of adjustable length and having a lower end with a V-shaped notch defining two spaced apart ears and two sets of holes in said ears, so that each ear has two holes aligned with similar holes in the other ear, and further comprising an additional segment extension for said second rail having a V-shaped protrusion with holes in said protrusion so that said second rail may be lengthened by positioning said additional segment at the lower end of said second rail and securing said segment to said lower end of said second rail by fasteners extending through the aligned holes in the ears and the protrusion, whereby said first rail can rest securely on top of the canvas as it rests on the ledge of the easel and said second rail can be supported by being bound to said first rail by said connection and by contacting the ledge without touching the canvas, thereby permitting an artist to rest his or her painting hand on the second rail while painting.

9. A painting arrangement for a painter comprising a canvas having a thickness and resting on an easel having a ledge, and a tool having first and second rails joined together by a pivotal connection, said pivotal connection being adjustably located along the length of one of said first and second rails and being tightenable to secure said rails in a set pivotal configuration along said adjustable length, said first rail being thicker than the canvas, said first rail resting securely on top of the canvas as it rests on the ledge of the easel and said second rail being supported by being bound to said first rail by said connection and by contacting the ledge without touching the canvas, thereby permitting an artist to rest his or her painting hand on the second rail while painting.

10. An apparatus as claimed in claim 9 wherein the location of said pivotal connection is adjustable along both of said first and second rails.

11. An apparatus as claimed in claim 9 wherein the location of said pivotal connection is adjustable by being slidable in a slot in one of the rails.

12. An apparatus as claimed in claim 9 wherein said second rail is of adjustable length.

13. An apparatus as claimed in claim 12 wherein said second rail has a lower end with a V-shaped notch defining two spaced apart ears and two sets of holes in said ears, so that each ear has two holes aligned with similar holes in the other ear, and further comprising an additional segment having a V-shaped protrusion with holes in said protrusion, whereby said second rail may be lengthened by positioning said additional segment at the lower end of said second rail and securing said segment to said lower end of said second rail by fasteners extending through the aligned holes in the ears and the protrusion.

14. An apparatus as claimed in claim 13 further comprising a plurality of said additional segments.

15. An apparatus as claimed in claim 9 wherein said first rail includes a backing plate and a slotted forward plate bound to said backing plate and having a widened slot portion where the forward plate is bound to said backing plate.

16. An apparatus as claimed in claim 15 wherein said connection comprises a nut and a bolt, said bolt having a head and a stem, said head being located in said widened slot portion with the stem extending out through the slotted forward plate to engage said second rail and be secured thereto by said nut.

17. An apparatus as claimed in claim 16 wherein said second rail has a slot and said stem extends through said slot.

18. An apparatus as claimed in claim 9 wherein said first rail is adapted to rest on the canvas by being thicker than the canvas.

19. An apparatus to assist a painter in painting a canvas resting on an easel having a ledge comprising first and second rails joined together by a pivotal connection, said pivotal connection being adjustably located along the length of one of said first and second rails and being tightenable to secure said rails in a set pivotal configuration along said adjustable length, wherein said second rail is of adjustable length by having a lower end with a V-shaped notch defining two spaced apart ears and two sets of holes in said ears, so that each ear has two holes aligned with similar holes in the other ear, an additional segment having a V-shaped protrusion with holes in said protrusion, whereby said second rail may be lengthened by positioning said additional segment at the lower end of said second rail and securing said segment to said lower end of said second rail by fasteners extending through the aligned holes in the ears and the protrusion, and whereby said first rail can rest securely on top of the canvas as it rests on the ledge of the easel and said second rail can be supported by being bound to said first rail by said connection and by contacting the ledge without touching the canvas, thereby permitting an artist to rest his or her painting hand on the second rail while painting.

20. An apparatus as claimed in claim 19 further comprising a plurality of said additional segments.

* * * * *